US005357713A

United States Patent [19]

Jiskoot et al.

[11] Patent Number: 5,357,713

[45] Date of Patent: Oct. 25, 1994

[54] APPARATUS FOR OPENING A GRAIN DOOR

[75] Inventors: Sid Jiskoot, Sanborn; Walter Lammers, Boyden, both of Iowa

[73] Assignee: Dethmers Manufacturing Company, Des Moines, Iowa

[21] Appl. No.: 60,581

[22] Filed: May 11, 1993

[51] Int. Cl.[5] ..... E05F 11/00

[52] U.S. Cl. ..... 49/276; 49/362; 222/559; 222/561

[58] Field of Search ..... 49/276, 279, 460, 362, 49/360; 222/505, 559, 561

[56] References Cited

U.S. PATENT DOCUMENTS

| | | | |
|---|---|---|---|
| 333,546 | 1/1886 | Prentiss et al. | 222/505 |
| 1,148,064 | 7/1915 | Vidal et al. | 49/276 |
| 1,428,732 | 9/1922 | Williams | 222/505 |
| 1,611,386 | 12/1926 | Stanley | 49/276 |
| 1,760,187 | 5/1930 | Brenne | 49/276 |
| 2,442,031 | 5/1948 | Beauchamp | 49/276 |

*Primary Examiner*—Michael J. Milano

*Attorney, Agent, or Firm*—Brian J. Laurenzo; Kent A. Herink; Brett J. Trout

[57] ABSTRACT

An opener of the door of a gravity flow vehicle which allows a mechanical advantage in initially raising the door. After the material within the vehicle begins to flow and decrease the effort required to raise the door, the mechanical advantage is bypassed so that the door may be quickly raised and lowered.

6 Claims, 3 Drawing Sheets

APPARATUS FOR OPENING A GRAIN DOOR

BACKGROUND OF THE INVENTION

The present invention relates generally to a door opener and, more particularly, to an opener for a door on a gravity flow grain vehicle which provides a large mechanical advantage until the door begins to move and then decreases the mechanical advantage to allow faster opening and closing of the door.

Gravity flow grain vehicles are well known in the art for transporting grain and other materials in an agricultural environment. Gravity flow vehicles are typically four-wheeled vehicles with two sides, a front, and a back. Typically, gravity flow vehicles empty from the side or rear of the vehicle. In a side emptying vehicle, the bottom of tile gravity bed vehicle slopes from the front toward the middle and from the back toward the middle. The floor of the gravity bed vehicle also typically slopes from one side to the other. This arrangement allows feed to empty from a side of the gravity bed vehicle onto a grate or auger without the need for excessive shoveling or tipping of the gravity flow vehicle. Gravity flow vehicles typically have a gate or door mounted to the discharge side of the vehicle which slides up to allow the grain to discharge from the vehicle and slides down again to stem the flow of the grain from the vehicle. The door is usually moved upward and downward by means of a hand wheel secured by a cross bar to the sides of the gravity flow vehicle. The hand wheel turns an axle which is connected to a pinion which engages a rack secured to the door. As the hand wheel turns the pinion, the pinion forces tile rack along with the door upward or downward to open or close the door and thereby increase or decrease the flow of grain from the vehicle.

Although the standard gravity flow vehicle and door assembly is very useful in the agricultural environment, a major disadvantage of the standard door opening assembly is the great difficulty encountered in first opening the door when the gravity flow vehicle is full of grain. When the gravity flow vehicle is full of grain, the grain exerts a tremendous amount of force against the door which presses the door firmly against the rails along which the door slides upward and downward. The door thus becomes wedged against the rails making upward and downward movement very difficult. A great deal of force must often be applied to the hand wheel to move the door open even a small distance to allow grain to begin to flow. Once the grain begins to flow, however, the shifting of the vehicle's contents eases the pressure against the door thereby allowing the door to be more easily opened or closed. Although it would be possible to increase the size of the hand wheel or decrease the size of the pinion to increase the mechanical advantage needed to open the door, this increase in mechanical advantage would also decrease the speed at which the door may be opened or closed after the grain begins to flow. It would, therefore, be desirable to create a door opener which had a very large mechanical advantage as the door is opened a very small amount to allow the pressure of the grain against the door to be overcome, yet had a lower mechanical advantage once the door began to open to allow the door to be opened and closed quickly.

The difficulties in the prior art door openers are substantially eliminated by the present invention.

SUMMARY OF THE INVENTION

Accordingly, it is an object of the present invention to provide a door opener which provides a large mechanical advantage to initially open a door.

It is another object of the present invention to provide a door opener which opens and closes quickly.

By the present invention, it is proposed to overcome the difficulties encountered heretofore. To this end, an opener for a door having a frame to which the door is slidably connected is provided. The opener includes a support secured to the frame and a means for leveraging tile door open against the support. The opener also includes a lift bar which is operably connected to the leveraging means.

Preferably, the lift bar is raised and lowered by a hand wheel connected to a rack and pinion assembly. The leveraging means is preferably a lever bar pivotally connected to the door. An additional lever bar, pivotal connection, and support are preferably provided so that both sides of the door may be lifted simultaneously. The lever bars' pivotal connection to the door allows the lever bars to lift the door by pressing against the supports. The lever action of the lever bars provides an increased mechanical advantage until the door has begun to open whereafter the lever bars contact the corners of the door instead of the supports. The opener thereby returns to its standard mechanical advantage which allows the door to be opened and closed quickly.

BRIEF DESCRIPTION OF THE DRAWINGS

FIG. 6 is an elevated view in partial cutaway showing the door in the raised position with the lever arms contacting the corners of the door.

DETAILED DESCRIPTION OF THE PRESENT INVENTION

Figure 1:
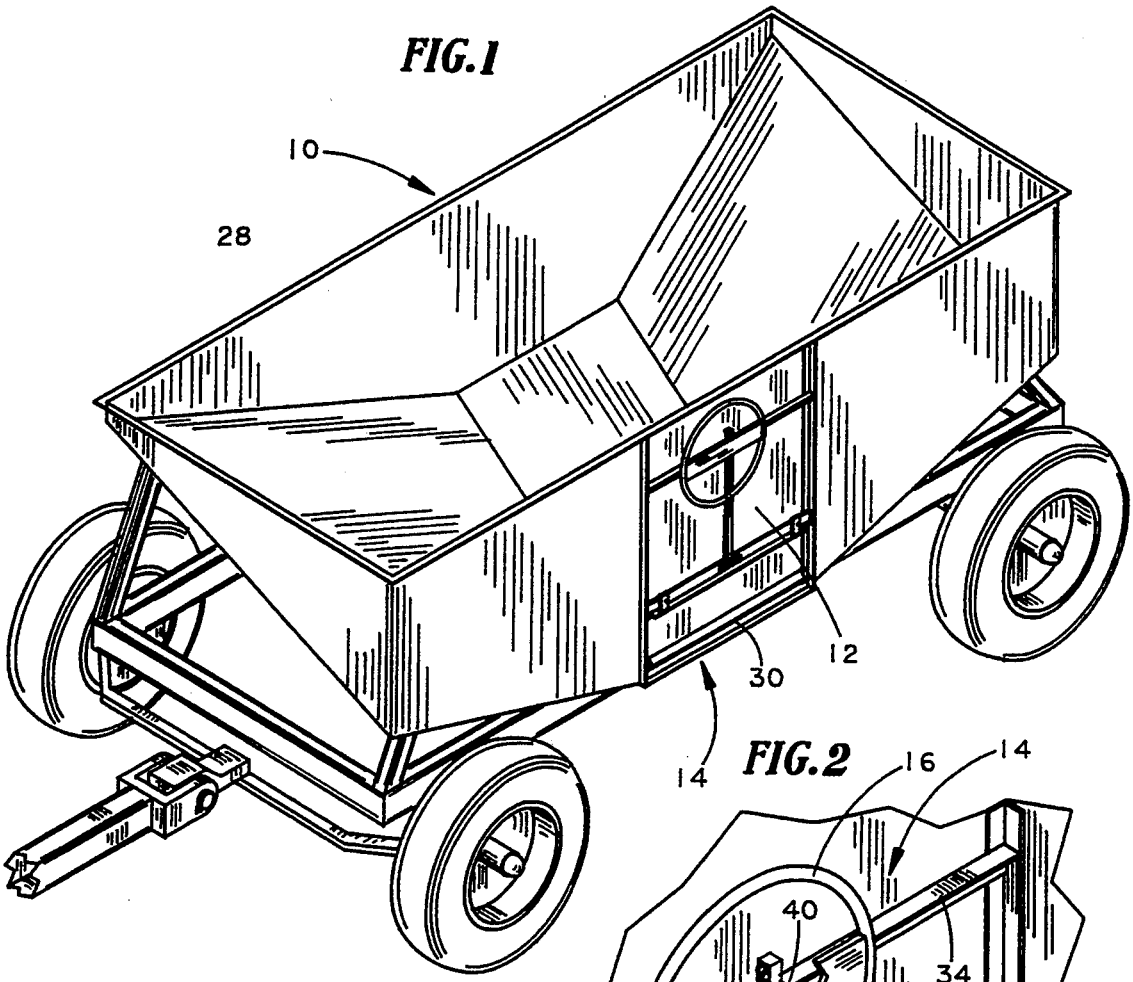
FIG. 1 is a perspective view of a gravity flow vehicle having a door which is opened by the opener of the present invention.

There is shown a gravity flow vehicle 10 having a door 12 and an opening apparatus 14. The opening apparatus 14 has a hand wheel 16 connected to a pinion 18 which engages a rack 20. The rack 20 is connected to a lift bar 22 so that as the hand wheel 16 is turned the lift bar 22 moves upward and downward in response thereto. A lever assembly 24 is pivotally connected to the lift bar 22 and the door 12. A pair of supports **26*a–b* are connected to the vehicle 10 to shoulder the lever assembly 24 and to act as a fulcrum as the lift bar 22 is raised. This leverage action gives a mechanical advantage as the door begins to lift. Once the door 12 has moved a short distance the lift bar 22 operably engages a limit member 48 connected to the door 12 and the leverage action is bypassed. The mechanical advantage is bypassed as well, thereby increasing the speed at which the door 12** may be raised or lowered.

Figure 4:
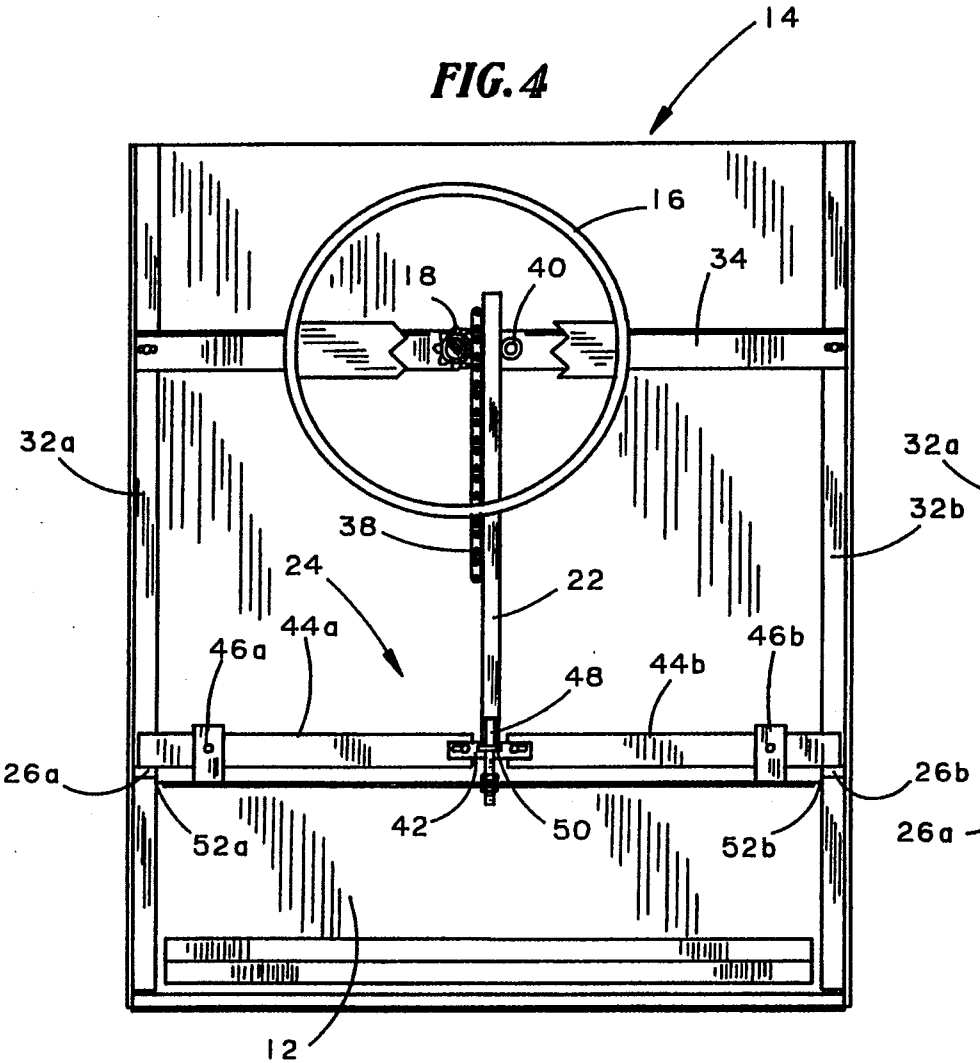
FIG. 4 is an elevated view in partial cutaway showing the door in the closed position.

In the figures, a novel opener 14 for a grain door 12 is shown which increases the mechanical advantage of the opener 14 as the door 12 begins to open and thereafter bypasses the mechanical advantage to speed the opening and closing of the door 12 (FIG. 4). FIG. 1 shows a gravity flow vehicle 10 preferably of the grain type which has a slanted bottom interior 28 to allow grain or similar material to flow out of the vehicle 10 through chute 30. The door 12 is slidably secured to the side of the vehicle 10 and covers the chute 30 to prevent grain from flowing out of the vehicle 10 as the vehicle is being filled or transported.

Figure 2:
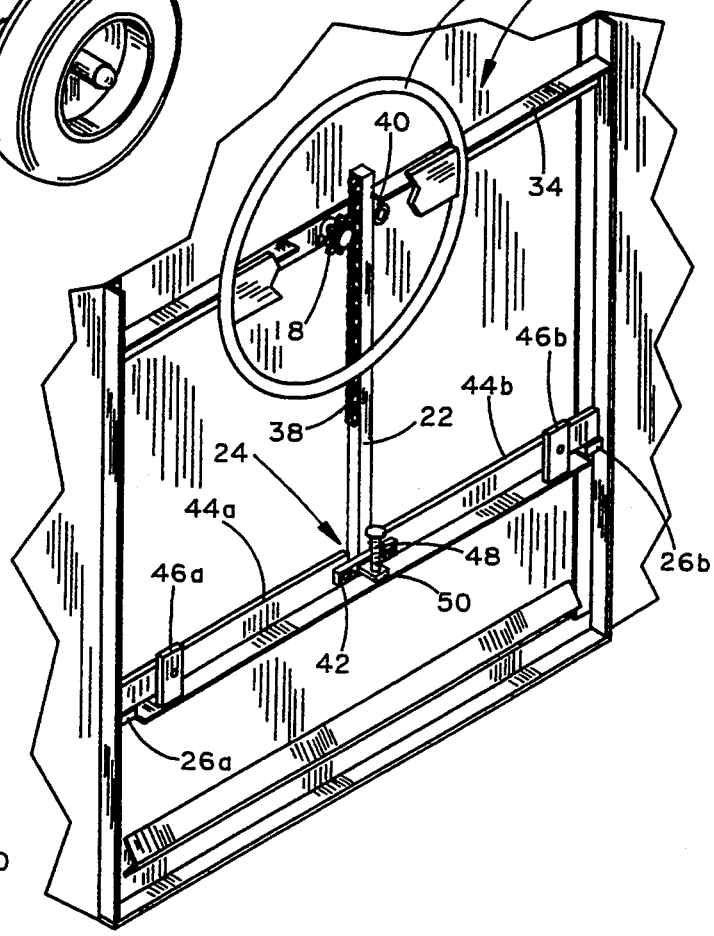
FIG. 2 is a perspective view of the grain door and opener showing the door in the closed position.

As shown in FIG. 2, the opener 14 is provided to open and close the door 12. The door 12 slides upward and downward along a pair of runners 32*a* and 32*b* which are secured to the side of the vehicle 10 by weldments or the like. A support bar 34 spans the door 12 and is secured to both runners 32 by bolts or similar securement means. A hand wheel 16 is provided and secured to an axle 36 which passes through a hole in the support bar 34. The axle 36 is secured on the opposite side of the support bar 34 to a pinion 18. As the hand wheel 16 is turned the axle 36 transfers this motion to the pinion 18 as the support bar 34 supports the axle 36.

Figure 3:
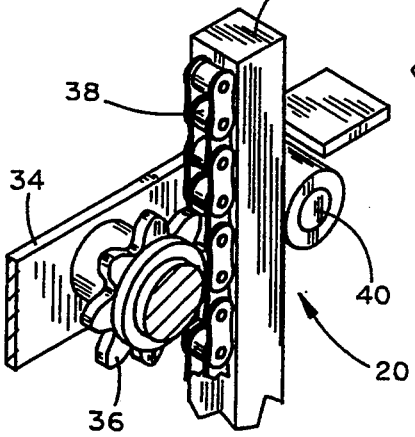
FIG. 3 is a close-up perspective view of the rack and pinion mechanism of the present invention.

Preferably, the pinion 18 engages a chain 38 which has been secured to a lift bar 22 by weldments or similar securement means (FIG. 3). Although the chain 38 is used in the preferred embodiment for ease of construction, it should be noted that any rack or similar lifting means may be used to replace the chain 38 in the preferred embodiment. A support roller 40 is secured to the support bar 34 to force the chain into drivable engagement with the pinion 18 and to prevent the support bar 22 from moving away from the pinion 18 during operation.

As the hand wheel 16 is turned, the lift bar 22 moves upward and downward in relationship to the support bar 34. The lower portion of the lift bar 22 is secured by weldments to a perpendicular connection plate 42. Each end of the connection plate 42 has a hole to connect the plate 42 by means of a bolt to a pair of lever arms 44*a–b*. The holes in the connection plate 42 may be elongated into slots to allow lost motion as the lift bar 22 is raised and lowered and the levers 44*a–b* move slightly back and forth.

Because the construction and function of the levers 44*a–b* are similar, description will be made only in relationship to a single lever 44*a*.

Two flanges 46*a–b* are secured to the top of the door 12 (FIG. 4). The lever 44*a* is connected by means of a pin or similar pivotal connection means to one of the flanges 46*a* to allow the lever 44*a* to lift the door 12. Depending on the mechanical advantage desired, the flanges 46*a–b* may be moved closer to the center of the door for a smaller mechanical advantages or outward toward the supports 26*a–b* for a larger mechanical advantage. The lever 44*a* extends past the flange 46*a* to rest on one of the supports 26*a*. The support 26*a* acts as a fulcrum by allowing the lever 44*a* to pivot and increasing the mechanical advantage of the force applied by the lift bar 22 as the force is transferred to the door 12 via the lever 44*a* and the flange 46*a*. Similar mechanical advantage of lever 44*b* is achieved with flange 46*b* and support 26*b*.

To override the mechanical advantage supplied by the levers 44*a–b* and allow the door 12 to be opened and closed more quickly a limit member 48 is provided (FIG. 2). Preferably the limit member 48 is a bolt which is secured to the top of the door 12 by a threaded hole or similar securement means. A bracket 50 having a hole is secured to the connection plate 42 by weldments so that the limit member 48 passes through the hole for slidable movement in relationship to the bracket 50. The top of the limit member 48 is larger than the hole in the bracket 50 so that as the bracket 50 is moved upward along the limit member 48, the top of the limit member 48 contacts the bracket 50 and the upward force of the bracket 50 is transferred to the limit member 48. As is shown in FIG. 6, the top of the limit member 48 contacts the bracket 50 before the levers 44*a–b* contact the corners 52*a–b* of the door 12 thereby preventing the levers 44*a–b* from damaging the door 12.

Figure 5:
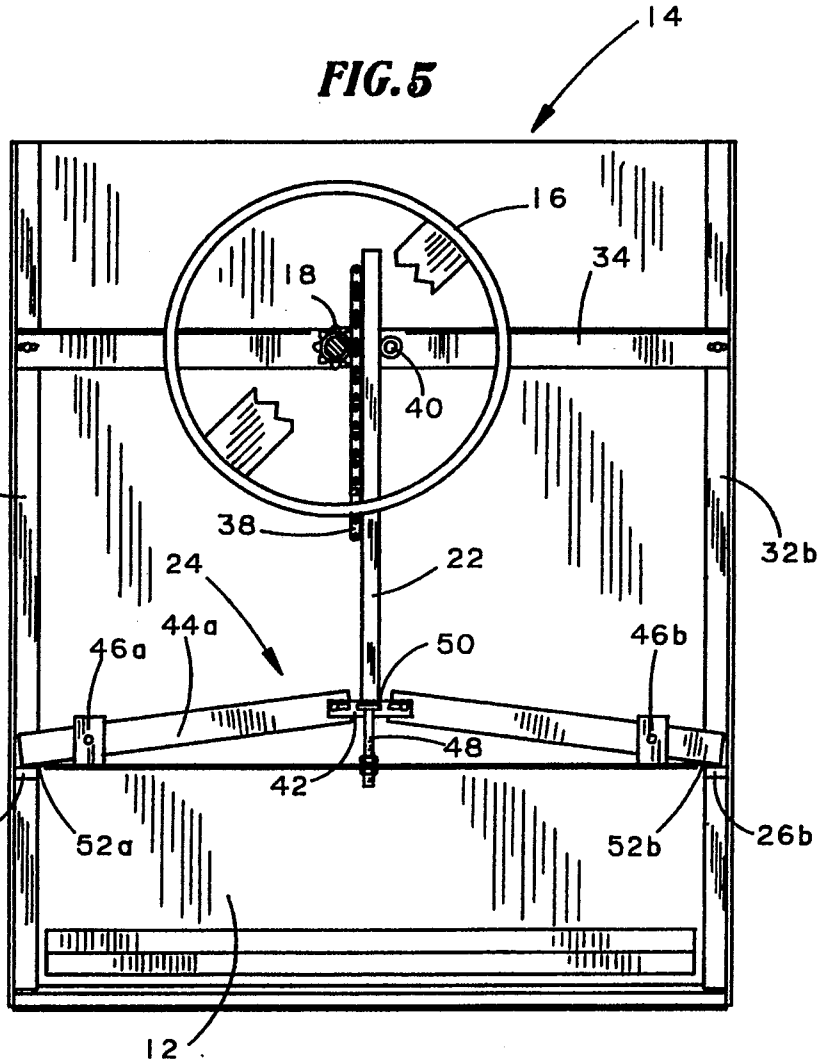
FIG. 5 is an elevated view in partial cutaway showing the door beginning to be raised and the lever arms pressing against the supports.

To raise the door 12 the hand wheel 16 is rotated in a counterclockwise direction which drives the pinion 18 in a counterclockwise direction as well. As the pinion 18 turns, the chain 38 engaged to the pinion 18 draws the lift bar 22 upward, which pulls the connection plate 42 upward and away from the door 12 (FIG. 5). As the connection plate 42 moves upward in relationship to the door 12, the lever 44*a* pivots on the support 26*a*. As shown in FIG. 5, the flange 46*a* is preferably positioned one quarter of the way along the lever 44*a* to provide a four to one mechanical advantage as the lift bar 22 moves upward and the lever 44*a* pivots on the support 26*a*. The lever 44*b* mounted to the other side of the connection plate 42 pivots on support 26*b* to raise the door 12 in an even manner. It should be noted that to increase the mechanical advantage of the opener 14 even more, the flanges 46*a–b* may be positioned closer to their respective supports 26*a–b*. Conversely, to decrease the mechanical advantage of the opener 14, the flanges 46*a–b* may be positioned closer to the lift bar 22.

As the lift arm 22 raises the connection plate 42, the bracket 50 comes into contact with the top of the limit member 48. The upward force of the lift arm 22 is then transferred through the limit member 48 rather than through the levers 44*a–b* and the mechanical advantage of the levers 44*a–b* is lost (FIG. 6). This loss of mechanical advantage is desirable after the door 12 has begun to move since the loss of mechanical advantage increases the speed with which the door 12 is raised. As the door 12 begins to raise, material within the vehicle 10 such as grain or the like begins to flow out of the chute 30 and the grain within the vehicle 10 begins to shift and move against the interior sides of the vehicle 10. As the grain shifts against the interior of the door 12, the pressure of the grain against the door 12 subsides and the door 12 becomes easier to raise and lower. It is, therefore, advantageous to lose the mechanical advantage of the levers 44*a–b* as soon as the door 12 becomes easier to open since the door may be raised and lowered more quickly.

As shown in FIG. 6, as the lift arm 22 continues to raise, the bracket 50 remains in contact with the top of the limit member 48. The levers 44*a–b* no longer pivot and, therefore, no longer give mechanical advantage to the lifting of the door 12. After the desired amount of grain or similar material has been extracted from the vehicle 10, the door 12 is then lowered by the hand wheel 16 to close the chute 30.

Figure 7:
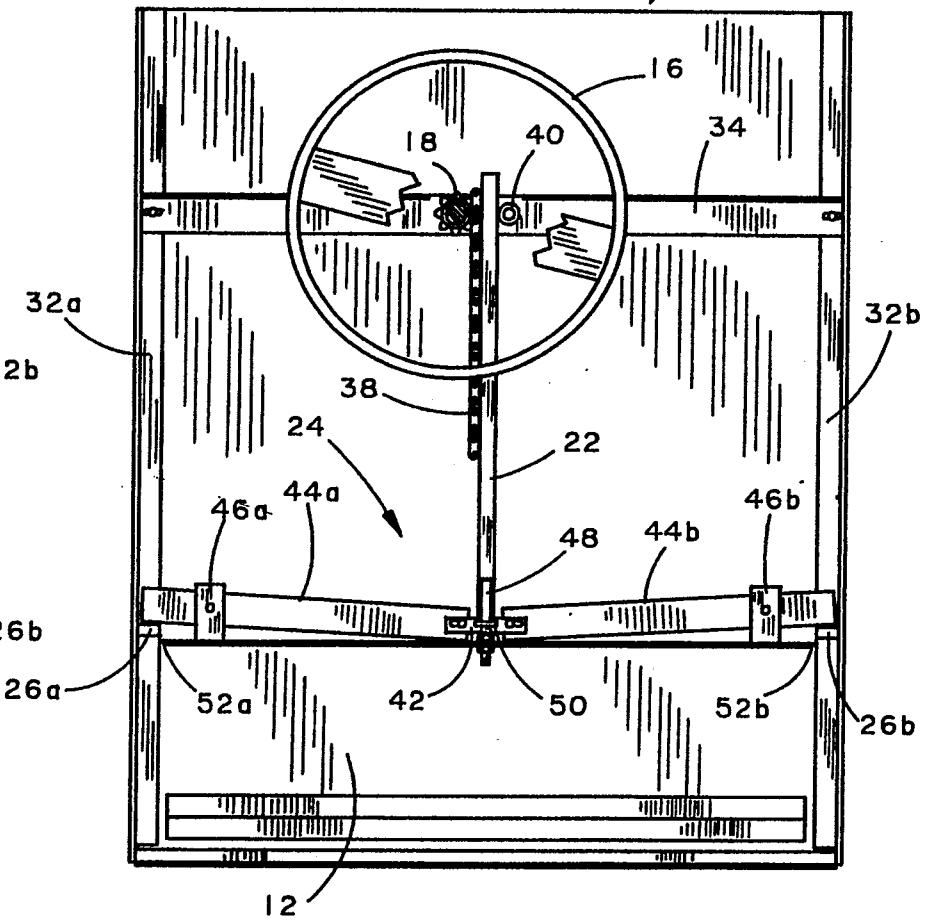
FIG. 7 is an elevated view in partial cutaway showing the door being closed with the connection plate pressing the lever arms against the door.
Figure 8:
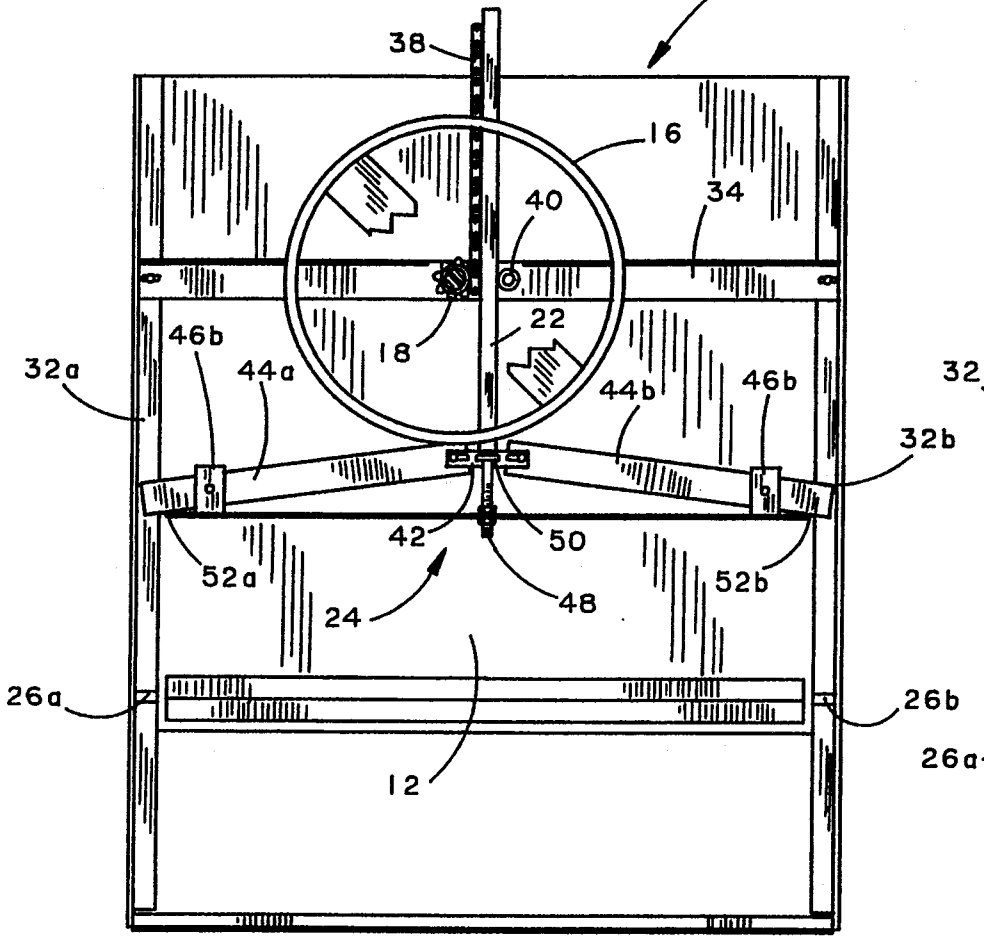

As the hand wheel 16 is rotated clockwise there is initially lost motion as the levers 44*a–b* straighten perpendicular to the lift bar 22 and the bracket 50 slides down the limit member 48. Thereafter the levers 44*a–b* move slightly past perpendicular until the connection plate 42 presses the levers 44*a–b* into contact with the door 12 (FIG. 7). The connection plate 42 continues to press the levers 44*a–b* against the door until the door 12 has been lowered to the proper height by the hand wheel 16.

The foregoing description and drawings merely explain and illustrate the invention and the invention is not limited thereto, except insofar as the claims are so limited, as those skilled in the art who have the disclosure before them will be able to make modifications and variations therein without departing from the scope of the invention. It is contemplated that mechanical advantage of the levers may be bypassed by means other than the limit member. For example, the top corners 52*a–b* of the door may be reinforced to contact and support the levers as soon as the door has opened a predetermined distance. By contacting the corners of the door, the mechanical advantage of the levers is bypassed thereby allowing the door to be opened and closed more quickly as is described in the preferred embodiment.

I claim:

1. An opener for a door having a door frame to which the door is slidably connected comprising:

(a) A lift bar operably connected to the door;
(b) means for manually lifting said lift bar;
(c) a support secured to the door frame;
(d) means for leveraging the door open against said support, wherein said leveraging means is operably connected to said lift bar; and
(e) second means to lift the door to bypass said leveraging means after the door has opened a predetermined distance.

2. An opener for a door having a door frame to which the door is slidably connected comprising:

(a) a lift bar operably connected to the door;
(b) means for manually lifting said lift bar;
(c) a support secured to the door frame; and
(d) means for leveraging the door open against said support wherein said leveraging means is operably connected to said lift bar;
(e) means for bypassing said leveraging means after the door has opened a predetermined distance, wherein said bypassing means is a limit member operably connected between said lift bar and the door.

3. The opener of claim 2, further comprising:

(a) a hand wheel;
(b) a pinion operably connected to said hand wheel;
(c) a rack secured to said lift bar and operably engaged with said pinion, wherein rotation of said hand wheel causes movement of said rack.

4. The opener of claim 2 wherein said leveraging means comprises a pair of lever bars pivotally connected to said lift bar.

5. The opener of claim 4 wherein said lever bars pivot on said support.

6. A hand operated grain door opener for sliding a grain door open and closed in relationship to a door frame having a first side and a second side comprising:

(a) a support bar secured to the door frame;
(b) a hand wheel secured to an axle, said axle being journaled to said support bar;
(c) a pinion secured to said axle;
(d) a rack secured to the door for engagement with said pinion;
(e) a limit member operably connected between said rack and the door for transferring force from said rack to the door;
(f) a first support secured to the first side of the door frame;
(g) a second support secured to the second side of the door frame;
(h) a first lever arm having a first pivot end and a first force end, said first pivot end being operably connected to said rack;
(i) first means for operably connecting said first lever arm to the door between said first pivot end and said first pressure end of said first lever arm, said first operable connection means thereby allowing said first pivot end to pivot on said first support;
(j) a second lever arm having a second pivot end and a second force end, said second pivot end being operably connected to said rack; and
(k) second means for operably connecting said second lever arm to the door between said second pivot end and said second pressure end of said second lever arm, said second operable connection means thereby allowing said second pivot end to pivot on said second support.

* * * * *